US005586746A

United States Patent [19]

Humpert et al.

[11] Patent Number: 5,586,746

[45] Date of Patent: Dec. 24, 1996

[54] FAUCET WITH MOTION-DETECTOR ON/OFF CONTROL

[75] Inventors: Jürgen Humpert, Hemer; Bruno Heimann, Fröndenberg; Christian Frankholz, Schwerte, all of Germany

[73] Assignee: Friedrich Grohe Aktiengesellschaft, Hemer, Germany

[21] Appl. No.: 488,479

[22] Filed: Jun. 8, 1995

[30] Foreign Application Priority Data

Jun. 10, 1994 [DE] Germany ..... 44 20 330.6

[51] Int. Cl.[6] ..... F16K 31/06; E03C 1/05

[52] U.S. Cl. ..... 251/129.04; 4/623

[58] Field of Search ..... 251/129.04; 4/623, 4/DIG. 3; 137/801

[56] References Cited

U.S. PATENT DOCUMENTS

| | | | |
|---|---|---|---|
| 4,839,039 | 6/1989 | Parsons et al. | 4/623 X |
| 5,060,323 | 10/1991 | Shaw | 4/DIG. 3 X |
| 5,169,118 | 12/1992 | Whiteside | 251/129.04 X |
| 5,224,509 | 7/1993 | Tanaka et al. | 251/129.04 X |
| 5,431,181 | 7/1995 | Saadi et al. | 4/DIG. 3 X |

FOREIGN PATENT DOCUMENTS

| | | |
|---|---|---|
| 391765 | 10/1990 | European Pat. Off. . |
| 409998 | 1/1991 | European Pat. Off. . |
| 2721154 | 11/1978 | Germany . |
| 921157 | 12/1992 | Germany . |
| 1079481 | 3/1989 | Japan . |
| 2140337 | 5/1990 | Japan . |

*Primary Examiner*—Kevin Lee
*Attorney, Agent, or Firm*—Herbert Dubno

[57] ABSTRACT

A plumbing fixture has a housing provided with a water inlet and formed with a water outlet and with a circuit pocket. This housing is secured to a support surface. An electrically operated valve in the body between the inlet and outlet has an electrical feed wire energizable for movement of the valve between a closed position blocking flow between the inlet and outlet and an open position permitting such flow. An insert fittable in the pocket is formed with a battery compartment holding a battery. A screw or the like fixed the insert in the pocket. An electrical circuit in the insert connected to the feed wire and to the battery opens the valve on detection of a solid object in front of the housing.

8 Claims, 3 Drawing Sheets

FAUCET WITH MOTION-DETECTOR ON/OFF CONTROL

FIELD OF THE INVENTION

The present invention relates to a plumbing fixture with a motion detector controlling flow. More particularly this invention concerns a faucet with a motion detector for on/off control.

BACKGROUND OF THE INVENTION

A plumbing fixture is known having a housing provided with a water inlet and formed with a water outlet and a battery compartment. This housing is secured to a support surface and holds an electrically operated valve between the inlet and outlet and having an electrical feed wire energizable for movement of the valve between a closed position blocking flow between the inlet and outlet and a closed position blocking such flow. A battery in the compartment is connected to an electrical circuit also connected to the feed wire for opening the valve on detection of a solid object in front of the housing. Normally the circuit is permanently mounted in the housing and the housing has a removable cover over the battery compartment for removal and replacement of the battery.

Such a fixture, typically set up as a proximity-opening mixing faucet, is quite difficult to service. Changing the battery is fairly difficult and the battery is in a location where it can easily be removed and stolen. If the circuit goes bad, the entire fixture must be replaced.

OBJECTS OF THE INVENTION

It is therefore an object of the present invention to provide an improved plumbing fixture.

Another object is the provision of such an improved plumbing fixture, in particular a proximity-controlled mixing faucet, which overcomes the above-given disadvantages, that is which is easy to service and repair.

SUMMARY OF THE INVENTION

A plumbing fixture has according to the invention a housing provided with a water inlet and formed with a water outlet and with a circuit pocket. This housing is secured to a support surface. An electrically operated valve in the body between the inlet and outlet has an electrical feed wire energizable for movement of the valve between a closed position blocking flow between the inlet and outlet and an open position permitting such flow. An insert fittable in the pocket is formed with a battery compartment holding a battery. A screw or the like fixed the insert in the pocket. An electrical circuit in the insert connected to the feed wire and to the battery opens the valve on detection of a solid object in front of the housing.

With this system the critical electronic elements of the fixture can be removed as a piece for easy servicing and/or replacement. The battery is totally contained in the fixture so it is safe, yet it also can easily be changed by removal of the insert when necessary. In fact the fixture can be made with the valve but combined later with an insert for proximity detection, temperature control, or the like.

According to the invention the insert is provided with a window and the circuit includes a proximity detector behind the window. In addition the housing includes a generally cylindrical core body and a sleeve fitted over the body. The body is centered on an axis, formed with the pocket and the outlet, and having a lower end engaging the surface and an upper end on which the valve is mounted. The pocket opens radially of the body and the sleeve is formed with a spout forming a continuation of the outlet. The fixing screw has a head bearing on the sleeve, passing through the body, and threaded into the insert. Thus this screw holds the outer sleeve on the body and the insert in the body, serving double duty.

The inlet is formed by a pair of axially extending feed tubes extending through the surface from the lower end and the insert is provided with a removable cover closing the battery compartment. This insert also has a rearwardly extending projection bearing rearwardly on the housing and the screw extends through the housing and is threaded into the projection. The projection therefore establishes the position of the insert in the pocket, ensuring that its outer surface sits flush with the outer surface of the sleeve.

For ease of servicing the wire is provided with a disconnectable plug-and-socket assembly for complete disconnection of the circuit from the valve. In addition the insert is provided with an annular seal engaging the pocket.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
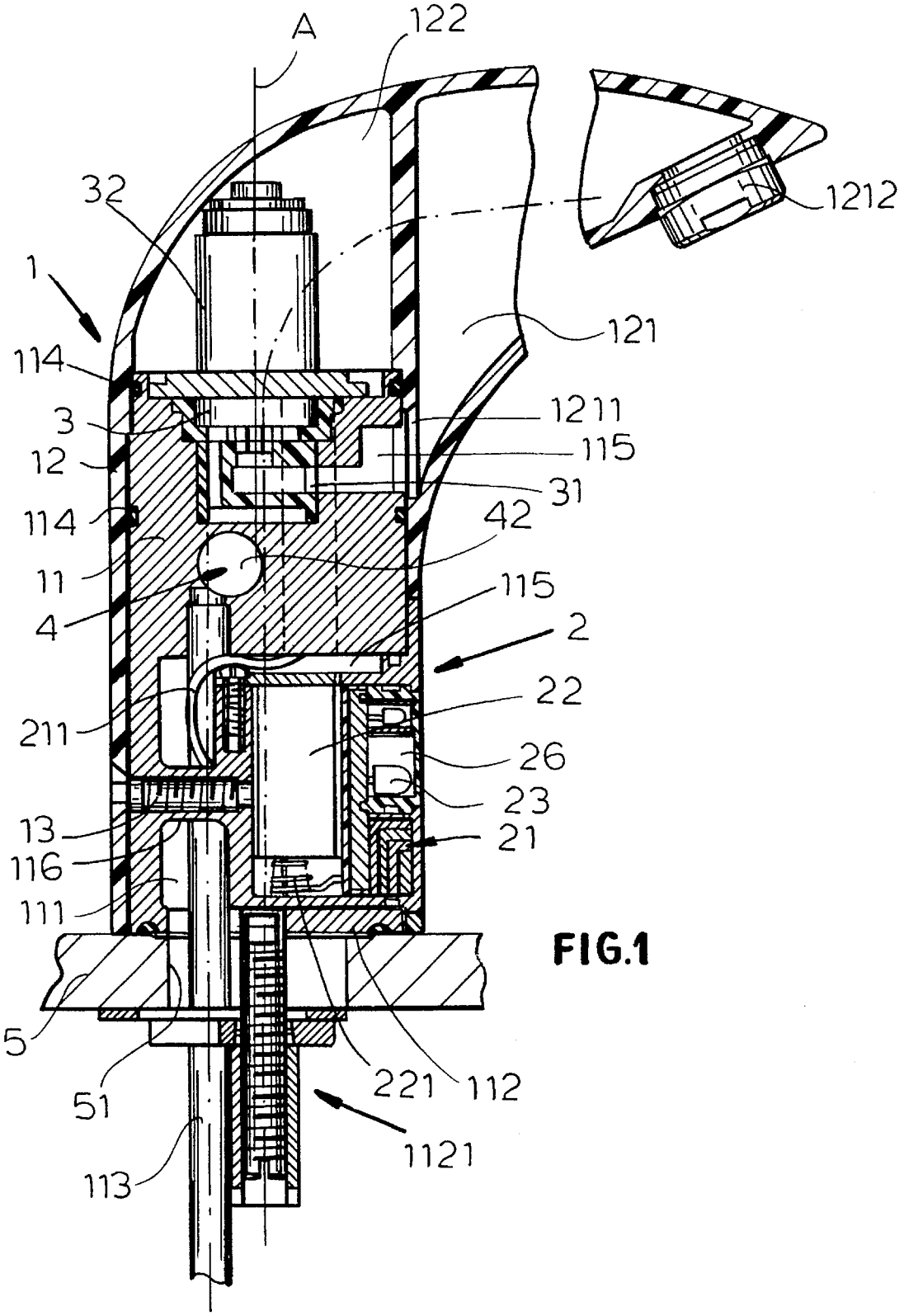
FIG. 1 is a vertical section through the fixture according to the invention.
Figure 2:
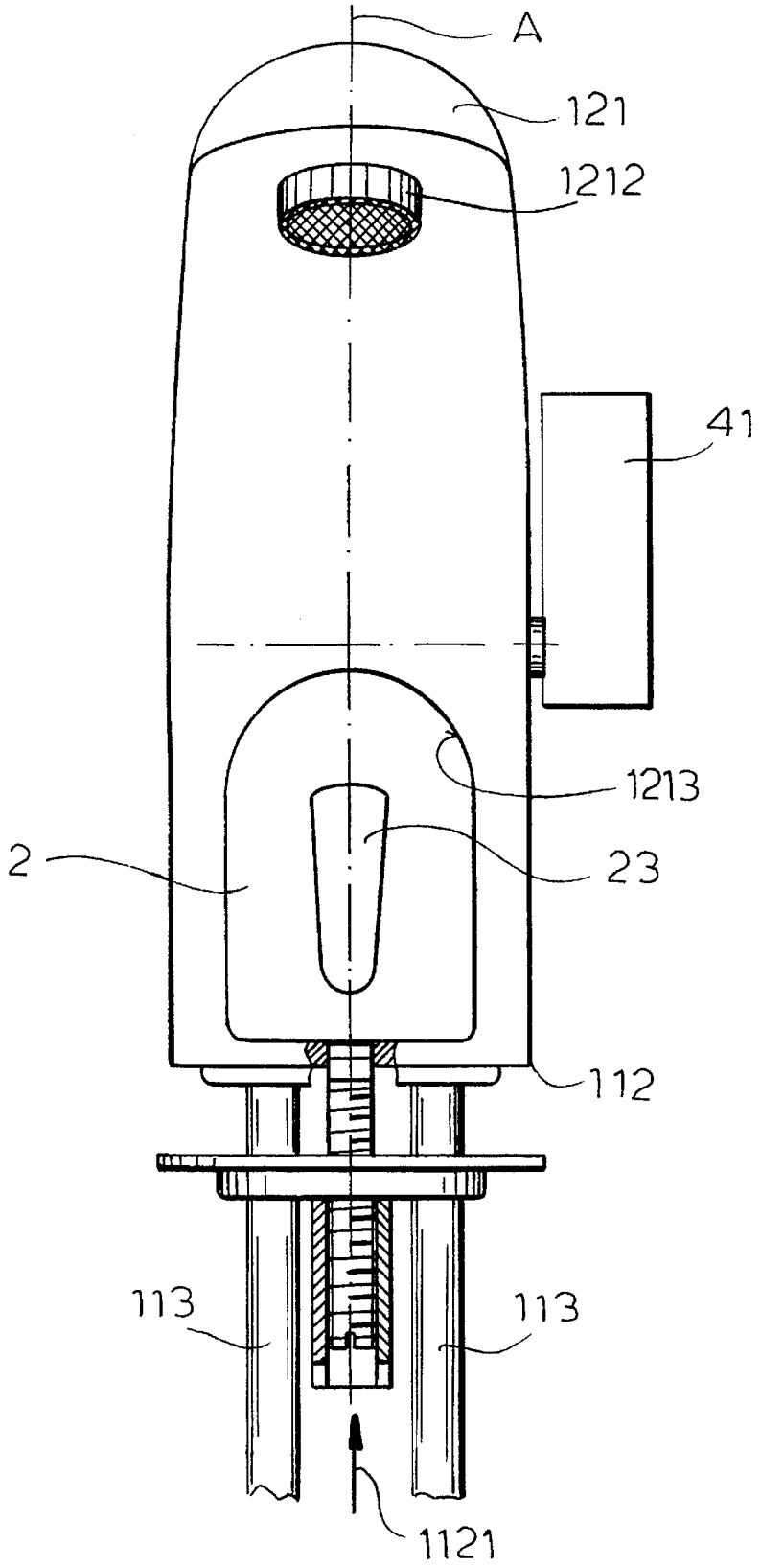
FIG. 2 is a front view partly in section through the fixture.
Figure 3:
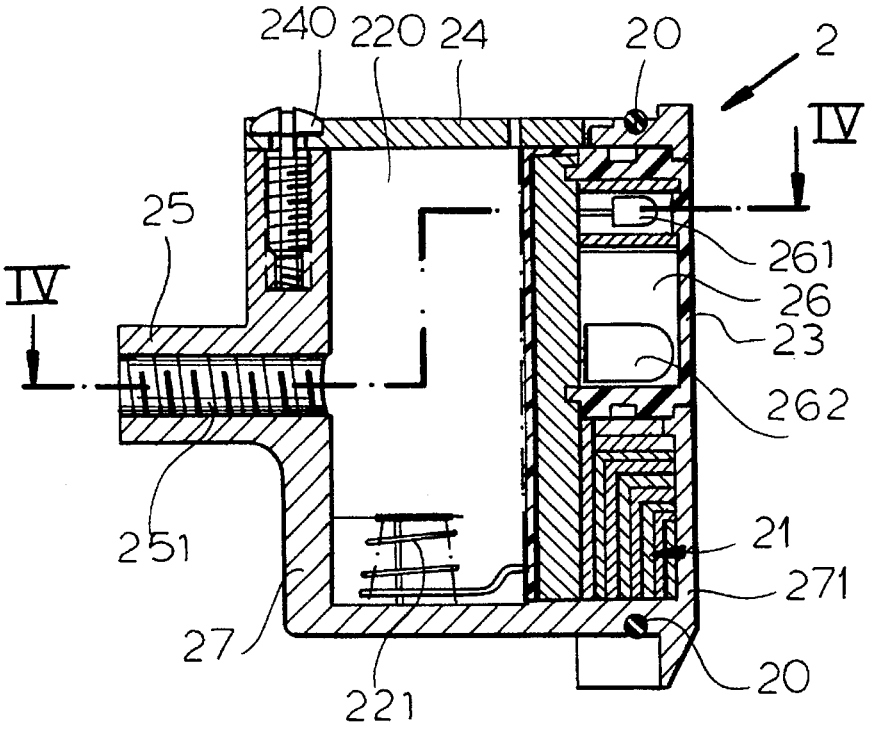
FIG. 3 is a large-scale detail view of the insert.
Figure 4:
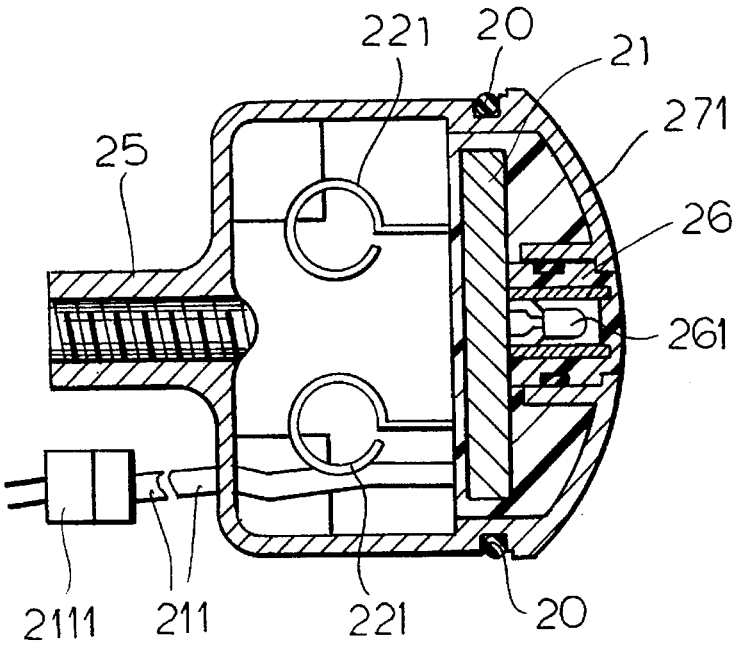
FIG. 4 is a section taken along line IV—IV of FIG. 3.

As seen in FIGS. 1 and 2 a plumbing fixture according to this invention basically comprises a housing 1 holding an electronics insert 2 and provided internally with an electromagnetically operable valve 3 and a mixing valve 4. The housing 1 is secured to a surface of a counter 5, although it could also be secured to a wall surface if appropriate. A screw assembly 1121 extends through a hole 51 in the counter 5 to hold the housing in place and hot- and cold-water feed tubes 113 extend through the hole 51 and have upper ends secured in the housing 1.

The valve 4 is of conventional design with an actuating lever 41 that varies the mix of hot and cold water fed to the valve 3. As is known, it has a pivotal spool 42 with a pair of V-shaped cutouts that can feed varying proportions of hot and cold water to an outlet side, keeping the volume rate of flow the same but changing the ratio of hot to cold water and, therefore, the temperature of the outflowing water. The valve 3 receives the tempered water from the mixing valve 4 and, when open, passes it to an outlet port 31.

The housing 1 itself comprises a solid core body 11 normally formed of cast metal and of basically cylindrical shape centered on a normally upright axis A and a metal-plated plastic outer sleeve 12 formed with a spout 121 having an aerator 1212. A port 1211 in the sleeve 12 is aligned with a passage 15 formed in the core body 11 to conduct flow from the valve outlet port 31 to the spout 121. A chamber 122 of the sleeve 12 contains a solenoid 32 of the valve 3 which sits atop the body 11. The supply lines 113 pass upwardly through a pocket 111 formed in the base surface 112 of the body 11 and have upper ends soldered in place in the body 11 immediately adjacent the valve 4 which is in fact in part formed by the core body 11. O-ring seals 114 flank the port 1211 and passage 115 so that all the flow from the valve 3 goes up the spout 121.

The insert 2 fits into a forwardly open pocket 115 aligned with an aperture 1213 of the sleeve 12. It has a body 27 having a front face 271 of the same shape and curvature as the shell 12 at the aperture 1213 and formed with a transparent window 23 behind which are situated a photodiode 261 and photocell 262 of a motion detector unit 26 associated with a circuit 21 contained in the insert 2. The insert body 27 is formed with a rearwardly projecting tubular extension 25 having a threaded bore 251 and that abuts against a tubular abutment 116 of the body 11. A screw 13 has a head bearing against the shell 12 at a hole therein and a shank that extends through the abutment 116 and into the extension 25 so that it locks the insert 2 in place while holding the sleeve 12 in position.

The body 27 of the insert 2 forms a battery compartment 220 having contacts 221 connected to the circuitry 21 and here adapted to engage the terminals of a battery shown at 22 in FIG. 1. A cover 24 normally closes the top of the compartment 220 and is held in place on the body 27 by a screw 240. A O-ring seal 20 around the insert body 27 engages the inner surface of the pocket 115 to prevent water from getting into the insert 2. A wire 211 provided with a separable plug-and-socket connector 2111 is connected between the circuitry 21 and the solenoid valve 3.

Thus the insert 2 is a wholly separate module that can be replaced and serviced easily. It can even be replaced with another of different capacity or function. When, for instance, the battery 22 needs replacement, one need merely unscrew the fixing screw 13 and pull the insert 2 out the front of the housing 1. Then the screw 240 is retracted to open the cover 24 and the old battery 22 is removed and a new one is installed in its place. Only a screwdriver is needed. If necessary the connector 2111 can be undone to wholly separate the insert 2 from the rest of the structure.

The screw 13 not only secures the insert 2 in place, but also retains the outer sleeve 12 on the core body 11. When the screw 13 is removed the sleeve 12 can be lifted off to give access to the valves 3 and 4.

We claim:

1. A plumbing fixture comprising:

a housing provided with a water inlet and formed with a water outlet and with a circuit pocket;

means for securing the housing to a support surface;

an electrically operated valve in the body between the inlet and outlet and having an electrical feed wire energizable for movement of the valve between a closed position blocking flow between the inlet and outlet and an open position permitting such flow;

an insert fittable in the pocket, provided with a window, and formed with a battery compartment;

means for fixing the insert in the pocket with the window facing forward out of the pocket;

a battery in the compartment; and electrical circuit means in the insert connected to the feed wire and to the battery and including a proximity detector behind the window for opening the valve on detection of a solid object in front of the housing.

2. The plumbing fixture defined in claim 1 wherein the fixing means includes a screw engageable through the housing into the insert.

3. The plumbing fixture defined in claim 1 wherein the insert is provided with a removable cover closing the battery compartment.

4. The plumbing fixture defined in claim 1 wherein the insert has a rearwardly extending projection bearing rearwardly on the housing and the fixing means includes a screw extending through the housing and threaded into the projection.

5. The plumbing fixture defined in claim 1 wherein the wire is provided with a disconnectable plug-and-socket assembly for complete disconnection of the circuit from the valve.

6. The plumbing fixture defined in claim 1 wherein the insert is provided with an annular seal engaging the pocket.

7. A plumbing fixture comprising:

a housing including a generally cylindrical core body centered on an axis, formed with a pocket, a water inlet, and a water outlet, and having a lower end and an upper end, the pocket opening radially of the body, and a sleeve formed with a spout forming a continuation of the outlet;

means for securing the lower end of the housing to a support surface;

an electrically operated valve mounted on the upper body end and between the inlet and outlet and having an electrical feed wire energizable for movement of the valve between a closed position blocking flow between the inlet and outlet and an open position permitting such flow;

an insert fittable in the pocket and formed with a battery compartment;

means including a screw engageable through the housing into the insert for fixing the insert in the pocket, the screw having a head bearing on the sleeve, passing through the body, and threaded into the insert;

a battery in the compartment; and electrical circuit means in the insert connected to the feed wire and to the battery for opening the valve on detection of a solid object in front of the housing.

8. The plumbing fixture defined in claim 7 wherein the inlet is formed by a pair of axially extending feed tubes extending through the surface from the lower end.

* * * * *